US010276087B2

(12) United States Patent
Shang et al.

(10) Patent No.: US 10,276,087 B2
(45) Date of Patent: Apr. 30, 2019

(54) GOA UNIT DRIVING CIRCUIT AND DRIVING METHOD THEREOF, DISPLAY PANEL AND DISPLAY DEVICE

(71) Applicant: BOE TECHNOLOGY GROUP CO., LTD., Beijing (CN)

(72) Inventors: Guangliang Shang, Beijing (CN); Seung Woo Han, Beijing (CN); Mingfu Han, Beijing (CN); Haoliang Zheng, Beijing (CN); Yanfeng Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 135 days.

(21) Appl. No.: 15/326,370

(22) PCT Filed: Dec. 14, 2015

(86) PCT No.: PCT/CN2015/097258

§ 371 (c)(1),
(2) Date: Jan. 13, 2017

(87) PCT Pub. No.: WO2017/012255

PCT Pub. Date: Jan. 26, 2017

(65) Prior Publication Data

US 2017/0213497 A1 Jul. 27, 2017

(30) Foreign Application Priority Data

Jul. 22, 2015 (CN) ..... 2015 1 0435690

(51) Int. Cl.
*G09G 3/20* (2006.01)

(52) U.S. Cl.
CPC ..... *G09G 3/2092* (2013.01); *G09G 3/20* (2013.01); *G09G 2300/0408* (2013.01);
(Continued)

(58) Field of Classification Search
CPC ..... G09G 3/2092; G09G 3/20; G09G 2310/0267; G09G 2310/08;
(Continued)

(56) References Cited

U.S. PATENT DOCUMENTS 9,368,230 B2 * 6/2016 Yao ..... G11C 19/184
10,147,394 B2 * 12/2018 Song ..... G09G 3/20
(Continued)

FOREIGN PATENT DOCUMENTS

CN 101950545 A 1/2011
CN 1011950545 * 1/2011 ..... G09G 3/36
(Continued)

OTHER PUBLICATIONS

International Search Report and Written Opinion (including English translation of Box V.) dated Apr. 26, 2016, for corresponding PCT Application No. PCT/CN2015/097258.
(Continued)

*Primary Examiner* — Mihir K Rayan
(74) *Attorney, Agent, or Firm* — Kinney & Lange, P.A.

(57) ABSTRACT

The present disclosure discloses a GOA unit driving circuit and a driving method thereof, a display panel and a display device. The disclosure relates to field of display technology, and solves the technical issue of increased power consumption of the display device due to the power consumption of the parasitic capacitance existing in the transistors in the GOA unit. The GOA unit driving circuit comprises a plurality of sets of GOA units, each of which includes at least one GOA unit; a plurality of clock selecting units, which are in one-to-one correspondence with the plurality of sets of GOA units, and each clock selecting unit is connected to a corresponding set of GOA units and connected to one of a plurality of clock signal terminals and at least one of a plurality of clock selection signal terminals, respectively. An
(Continued)

intersection of any two sets of GOA units in the plurality of sets of GOA unit is an empty set, and each clock selecting unit transmits a signal of the clock signal terminal to which the clock selecting unit is connected to the corresponding set of GOA units, under control of a signal of the at least one clock selection signal terminal to which the clock selecting unit is connected. The GOA unit driving circuit provided by the present disclosure may be applied to a display device.

11 Claims, 5 Drawing Sheets

(52) U.S. Cl.
CPC . *G09G 2300/08* (2013.01); *G09G 2310/0248* (2013.01); *G09G 2310/0267* (2013.01); *G09G 2310/08* (2013.01); *G09G 2330/021* (2013.01)

(58) Field of Classification Search
CPC ... G09G 2310/0248; G09G 2300/0408; G09G 2300/08; G09G 2330/021
See application file for complete search history.

(56) References Cited

U.S. PATENT DOCUMENTS

2004/0252094 A1 12/2004 Shih et al.
2008/0238897 A1* 10/2008 Kimura ..... G09G 3/3614 345/204
2015/0154927 A1* 6/2015 Li ..... G09G 3/3677 345/214
2016/0259455 A1* 9/2016 Li ..... G06F 3/0412
2016/0358586 A1* 12/2016 Song ..... G09G 3/20
2016/0372078 A1* 12/2016 Song ..... G09G 3/20

FOREIGN PATENT DOCUMENTS

CN 103258514 A 8/2013
CN 103744206 A 4/2014
CN 104575353 A 4/2015
CN 104599657 A 5/2015
KR 20070000984 A 1/2007

OTHER PUBLICATIONS

First Chinese Office Action, for Chinese Patent Application No. 201510435690.8, dated Jun. 2, 2017, 9 pages.
Second Chinese Office Action, for Chinese Patent Application No. 201510435690.8, dated Nov. 16, 2017, 10 pages.

* cited by examiner

GOA UNIT DRIVING CIRCUIT AND DRIVING METHOD THEREOF, DISPLAY PANEL AND DISPLAY DEVICE

CROSS-REFERENCE TO RELATED APPLICATION(S)

This application claims the benefit of Chinese Patent Application No. 201510435690.8 filed on Jul. 22, 2015 and entitled "GOA UNIT DRIVING CIRCUITS AND DRIVING METHOD THEREOF, DISPLAY PANELS AND DISPLAY DEVICES," which is incorporated herein by reference in entirety.

FIELD OF INVENTION

The present disclosure relates to a display technique, especially to GOA unit driving circuits and driving methods thereof, display panels and display devices.

BACKGROUND

GOA (Gate Driver on Array) technology is a technology that integrates a gate driving circuit of a display device on an array substrate to form a plurality of GOA units, thereby saving material cost and space for additionally providing gate driving circuit. Thus, the GOA technology is widely used due to its advantages of decreasing production costs and power consumption and being suitable for achieving narrow frame of the display device.

The GOA unit driving circuit is used to drive a plurality of GOA units inside the GOA unit driving circuit, an input terminal of each GOA unit is connected to all clock signal terminals, and an output end of each GOA unit is connected to one gate line to realize a function of gate line scanning. For example, as shown in FIG. 1, input terminals of GOA units 1 to (n+1) are all connected to two clock signal terminals CLK and CLKB, an output terminal OUT1 of the GOA unit 1 is connected to the first gate line G1, an output terminal OUT2 of the GOA unit 2 is connected to the second gate line G2. However, since each of the GOA units is composed of a plurality of transistors and the signal at the clock signal terminal will charge or discharge parasitic capacitance existing in the transistors in all of the GOA units at rising stage or falling stage. Therefore, the parasitic capacitance existing in the transistors in all of the GOA units will consume a large amount of electric energy, resulting in increase of power consumption of the display device.

SUMMARY OF THE INVENTION

It is an object of the present disclosure to provide a GOA unit driving circuit and a driving method thereof, a display panel and a display device for reducing electric power consumed by the parasitic capacitance in the display device, thereby reducing the power consumption of the display device.

In order to achieve the above objects, the present disclosure provides the following technical solutions.

In a first aspect, the present disclosure provides a gate driver on array (GOA) unit driving circuit. The GOA unit driving circuit comprises: a plurality of sets of GOA units, each of which includes at least one GOA unit; a plurality of clock selecting units, which are in one-to-one correspondence with the plurality of sets of GOA units, and each clock selecting unit is connected to a corresponding set of GOA units and connected to one of a plurality of clock signal terminals and at least one of a plurality of clock selection signal terminals, respectively, wherein an intersection of any two sets of GOA units in the plurality of sets of GOA unit is an empty set, and each clock selecting unit transmits a signal of the clock signal terminal to which the clock selecting unit is connected to the corresponding set of GOA units, under control of a signal of the at least one clock selection signal terminal to which the clock selecting unit is connected.

In a second aspect, the present disclosure provides a method for driving the GOA unit driving circuit as mentioned above. The method comprises: receiving a clock selection signal from a clock selection signal terminal and a clock signal from a clock signal terminal; and transmitting the clock signal to the set of GOA units according to the clock selection signal.

In a third aspect, the present disclosure provides a display panel. The display panel comprises the GOA unit driving circuit as mentioned above.

In a fourth aspect, the present disclosure provides a display device. The display device comprises the display panel as mentioned above.

BRIEF DESCRIPTION OF THE DRAWINGS

The drawings described herein are provided to further understand the present disclosure and constitutes a part of the present disclosure. The schematic embodiments of the present disclosure and their explanations are to interpret the present disclosure and are not intended to improperly define the present disclosure. In the accompany drawings.

DETAILED DESCRIPTION OF PREFERRED EMBODIMENTS

Figure 1:
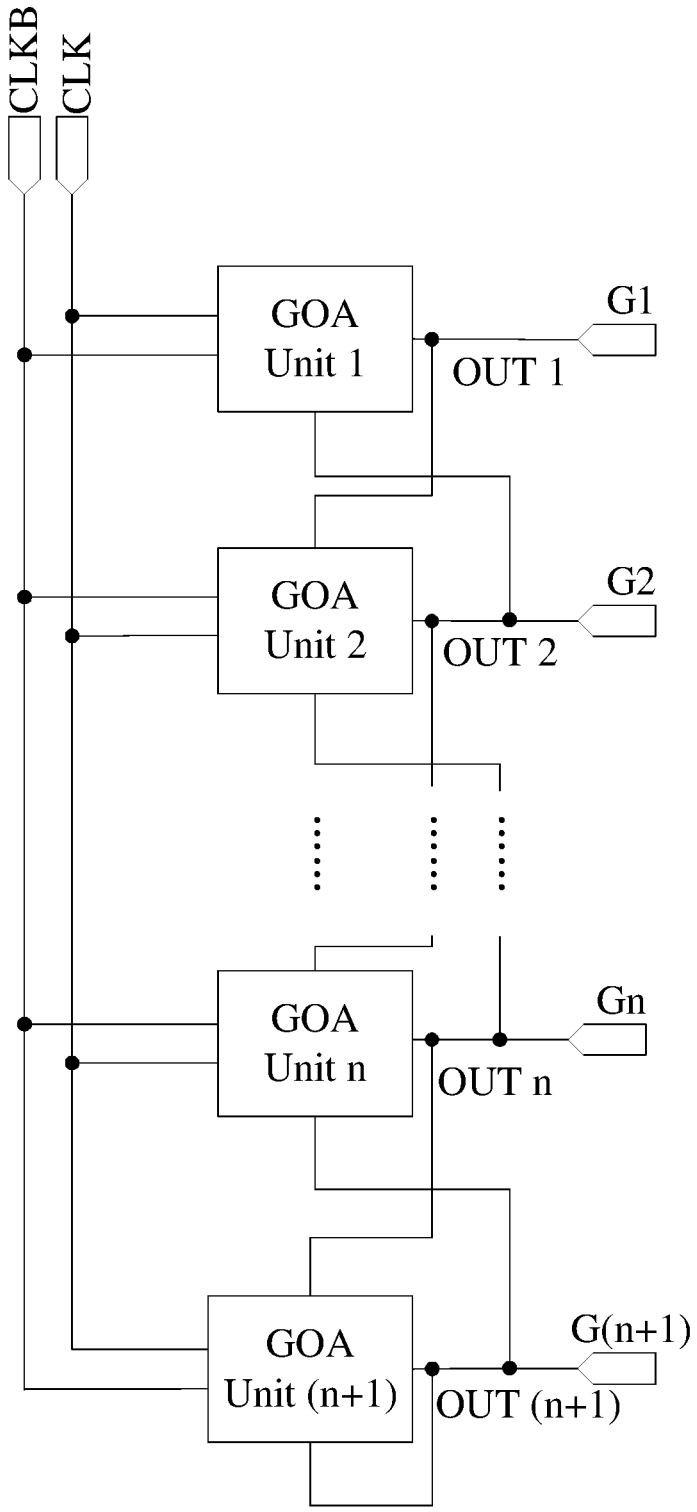
FIG. 1 is a schematic view of arrangement of a conventional GOA unit driving circuit.

In order to further explain the GOA unit driving circuit, the driving method, the display panel, and the display device according to the embodiments of the present disclosure, the following will be described in detail with reference to the accompanying drawings.

First Embodiment

The GOA unit driving circuit provided by the embodiment of the present disclosure comprises a plurality of clock signal terminals, a plurality of clock selection signal terminals, a plurality of clock selecting units and a plurality of sets of Gate Driver on Array (GOA) units. Each set of GOA units includes at least one GOA unit. Each clock selecting unit is connected to one clock signal terminal, at least one clock signal terminal selection terminal and one set of GOA units. An intersection of the sets of GOA units respectively connected to any two of clock selecting units is an empty set, i.e. the sets of GOA units connected to any two of the clock selecting units do not contain any common GOA units. For example, the GOA unit driving circuit includes four GOA units, namely, GOA unit a, GOA unit b, GOA unit c and GOA unit d, which are divided into two sets of GOA units. The first set of GOA units includes GOA unit a and GOA unit b, and the second set of GOA units includes GOA unit c and GOA unit d. There will never be a case where the first set of GOA units includes the GOA unit a and the second set of GOA units also includes the GOA unit a. The embodiment of the present disclosure divides all of the GOA units in the GOA unit driving circuit into several groups. Each of the groups constitutes one set of GOA units, and the GOA units in different sets of GOA units are different from each other. It should be noted that the number of GOA units in different sets of GOA units may be the same or different. The clock selecting unit transmits signals of the clock signal terminals to the sets of GOA units in a time division manner under control of the signal of the clock selection signal terminals.

As compared with the conventional GOA unit driving circuit in which the signals of the clock signal terminals are simultaneously received by all of the GOA units, the GOA unit driving circuit in the embodiment of the present disclosure would be able to reduce the power consumption of the display device. For example, the GOA unit driving circuit includes one hundred GOA units, which are divided into five sets of GOA units and each set of the GOA units includes twenty GOA units. Under control of respective clock selecting units, the five sets of GOA units receive the signal of the clock signal terminal in a time division manner, respectively. During a time period t1, only the first set of GOA units can receive the signal of the clock signal terminal. During a time period t2, only the second set of GOA units can receive the signal of the clock signal terminal. During a time period t3, only the third set of GOA units can receive the signal of the clock signal terminal. During a time period t4, only the fourth set of GOA units can receive the signal of the clock signal terminal. During a time period t5, only the fifth set of GOA units can receive the signal of the clock signal terminal. That is, only ⅕ of the GOA units can receive the signal of the clock signal terminal each time, which means the power consumption reduces 80%.

Figure 2:
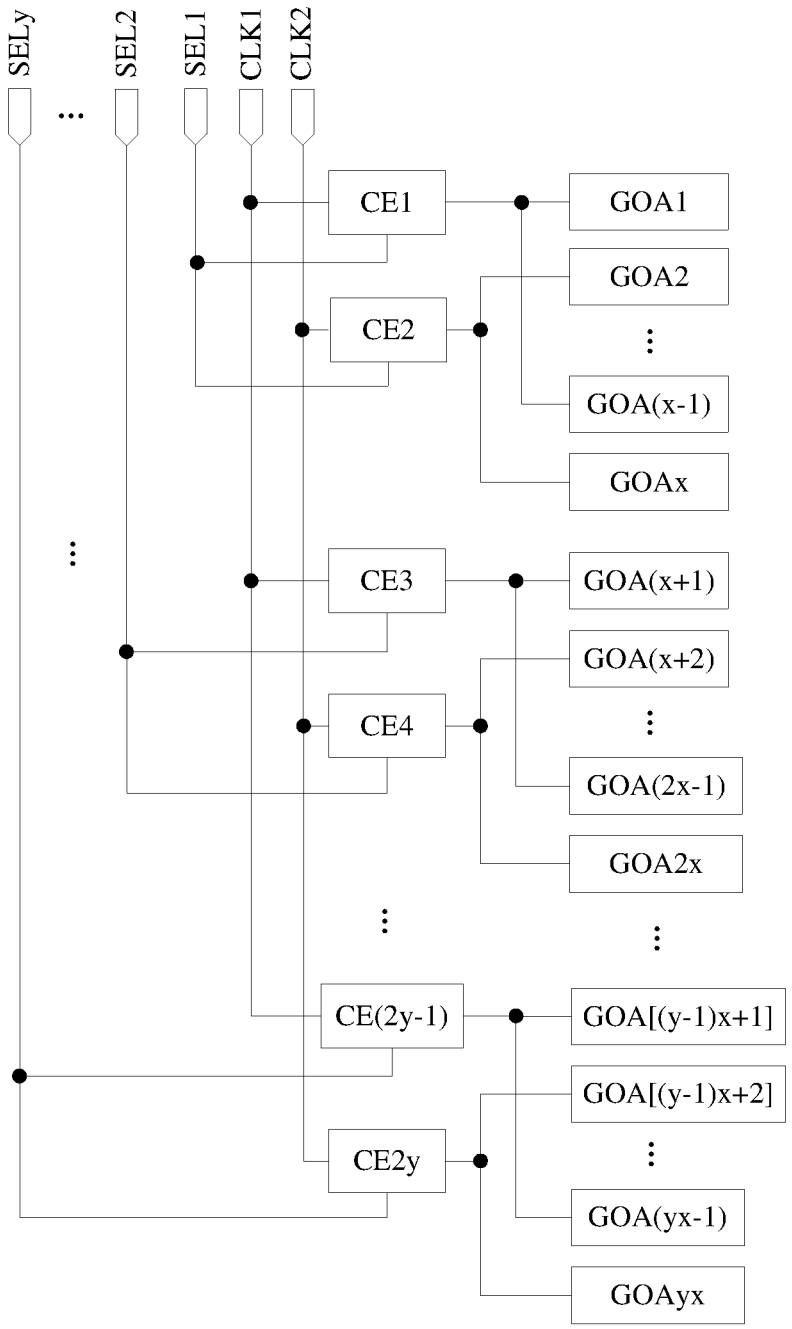
FIG. 2 is a schematic view of arrangement of a GOA unit driving circuit according to a first embodiment of the present disclosure.

Referring to FIG. 2, taking as example the GOA unit driving circuit including two clock signal terminals of CLK1 and CLK2, y clock selection signal terminals of SEL1 to SELy, 2*y* clock selecting units of CE1 to CE2*y*, and yxx GOA units of GOA1 to GOAyx, a structure of the GOA unit driving circuit will be described. In FIG. 2, only one clock selection signal terminal is connected to each of the clock selecting units. For example, the clock selecting unit CE1 is connected to the clock signal terminal CLK1, the clock selection signal terminal SEL1 and the GOA units of GOA1, . . . , GOA (x-1), wherein GOA units of GOA1, . . . , GOA (x-1) constitute one set of GOA units, and the GOA units are connected to gate lines (not shown in FIG. 2). The clock selecting unit CE2 is connected to the clock signal terminal CLK2, the clock selection signal terminal SEL1, and the GOA units of GOA2, . . . , GOAx, wherein the GOA units of GOA2, . . . , GOAx constitute another set of GOA units. Since particular arrangements respectively connected to the clock selecting units CE3, CE4, . . . , CE (2*y*-1) and CE2*y* are similar to those connected to the clock selecting units CE1 and CE2 as mentioned above, they will not be described here for brevity.

Figure 3:
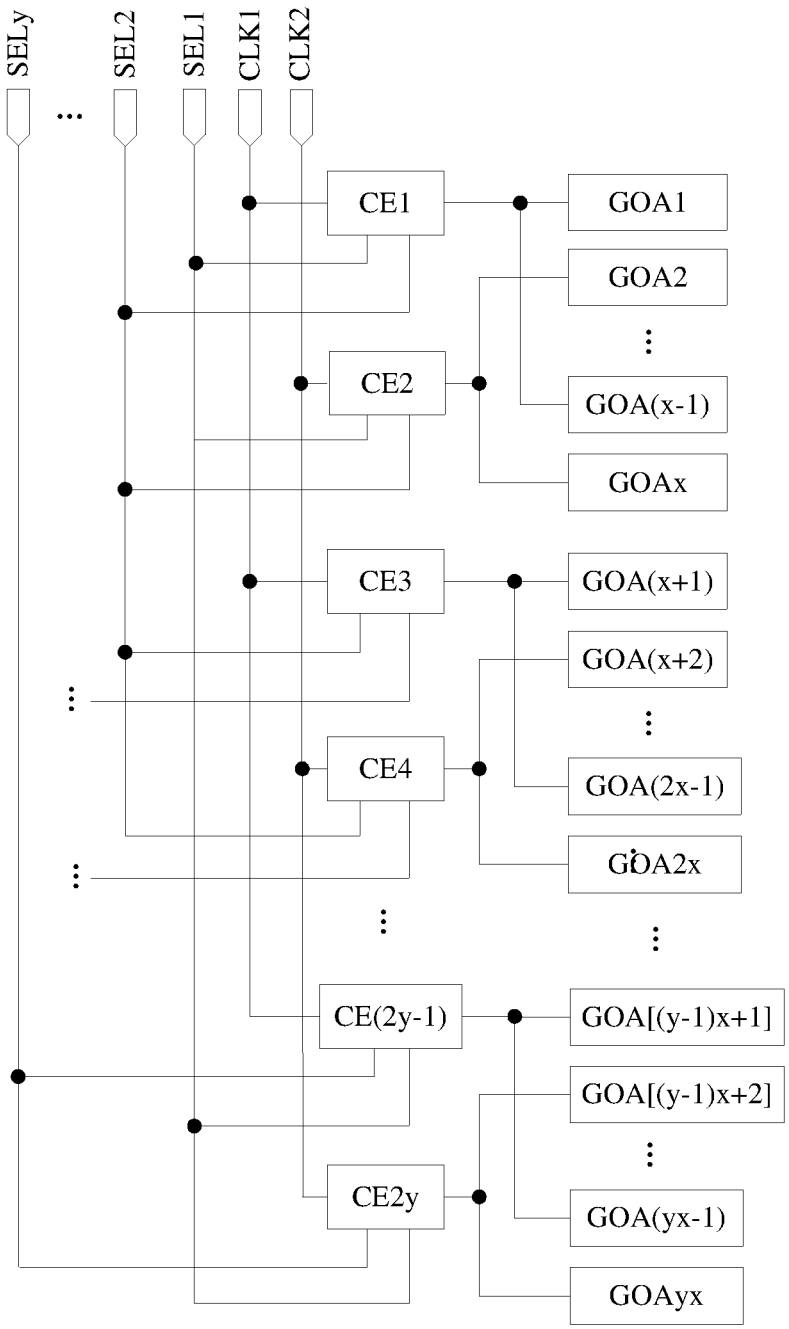
FIG. 3 is a schematic view of arrangement of another GOA unit driving circuit according to a first embodiment of the present disclosure.

Referring to FIG. 3, taking as example the GOA unit driving circuit including two clock signal terminals of CLK1 and CLK2, y clock selection signal terminals of SEL1 to SELy, 2*y* clock selecting units of CE1 to CE2*y*, and yxx GOA units of GOA1 to GOAyx, a structure of the GOA unit driving circuit will be described. In FIG. 3, two clock selection signal terminals are connected to each of the clock selecting units. For example, the clock selecting unit CE1 is connected to the clock signal terminal CLK1, the clock selection signal terminals SEL1 and SEL2 and the GOA units of GOA1, . . . , GOA (x-1), wherein GOA units of GOA1, . . . , GOA(x-1) constitute one set of GOA units, and the GOA units are connected to gate lines (not shown in FIG. 3). The clock selecting unit CE2 is connected to the clock signal terminal CLK2, the clock selection signal terminals SEL1 and SEL2, and the GOA units of GOA2, . . . , GOAx, wherein the GOA units of GOA2, . . . , GOAx constitute another set of GOA units. Since particular arrangements connected to the clock selecting units CE3, CE4, . . . , CE (2*y*-1) and CE2*y* are similar to those connected to the clock selecting units CE1 and CE2 as mentioned above, they will not be described here for brevity.

Figure 4:
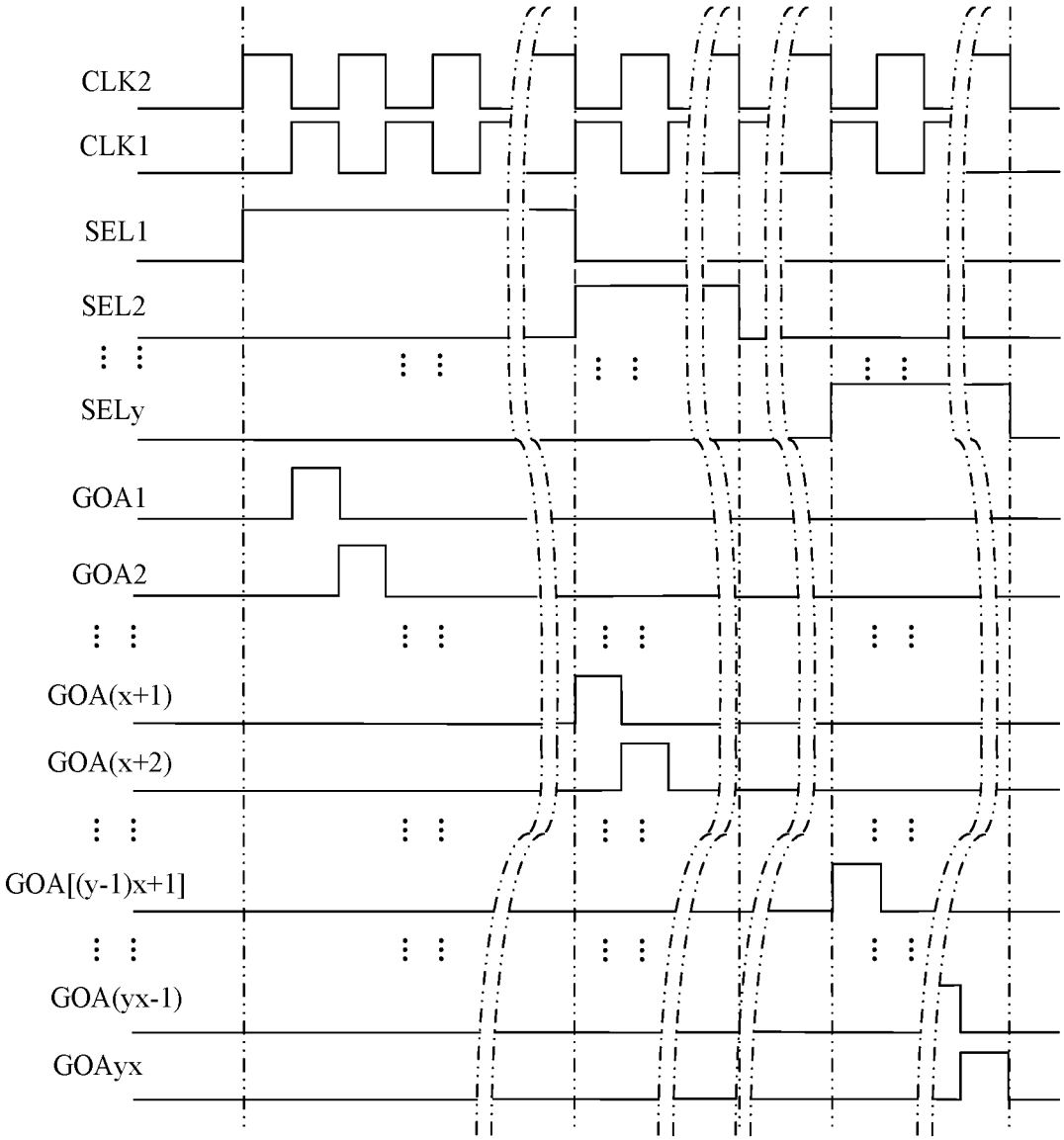
FIG. 4 is a signal timing chart corresponding to the GOA unit driving circuit in FIG. 2.

A method for driving the GOA unit driving circuit will be described in conjunction with the structure of the above-described GOA unit driving circuit. The clock selecting unit in the GOA unit driving circuit receives the signal of the clock selection signal terminal and the signal of the clock signal terminal, and transmits the signal of the clock signal terminal to the set of GOA units to which the clock selecting unit itself is connected according to the signal of the clock selection signal terminal. For example and by referring to FIG. 4, FIG. 4 is a signal timing chart corresponding to the GOA unit driving circuit of FIG. 2. When the signal of the clock selection signal terminal connected to the clock selecting unit is set to a high level signal, the clock selecting unit is turned on so that the signal of the clock signal terminal is transmitted to the set of GOA units to which the clock selecting unit is connected. When the signal of the clock selection signal terminal SEL1 is at the high level, the clock selecting unit CE1 transmits the signal of the clock signal terminal CLK1 to the GOA units of GOA1, . . . , GOA(x-1) such that the GOA units of GOA1, . . . , GOA(x-1) may normally output shifted waveforms; the clock selecting unit CE2 transmits the signal of the clock signal terminal CLK2 to the GOA units of GOA2, . . . , GOAx such that the GOA units GOA2, . . . , GOAx may normally output the shifted waveforms. The signals of the clock selection signal terminals to which the remaining clock selecting units are connected and the signal timing sequence of the GOA units are similar to those of the clock selecting units CE1 and CE2, so they will not be described here for brevity.

It should be noted that two clock signal terminals are particularly taken as an example, but in an actual design, the number of the clock signal terminals may be three, four, six, eight or other numbers.

In the GOA unit driving circuit and its driving method, the display panel and the display device provided by the present disclosure, the GOA unit driving circuit comprises a plurality of clock signal terminals, a plurality of clock selection signal terminals, a plurality of clock selecting units and a plurality of sets of GOA units. Each set of the GOA units comprises at least one GOA unit, and each of the clock selecting units is connected to a clock signal terminal, at least one clock selection signal terminal and a set of GOA units. As compared with the GOA unit driving circuit of the priory art in which each of the GOA units is directly connected to all of the clock signal terminals, the present disclosure divides all of the GOA units in the GOA unit driving circuit into a plurality of sets of GOA units, and the clock selecting unit in the GOA unit driving circuit is able to transmit signals at the clock signal terminal to the set of GOA units in a time division manner under control of the signal at the clock selection signal terminal, so that during a certain time period, only a group of the GOA units among all GOA units receive signals at the clock signal terminals, that is, the number of the GOA unit that receives the signal at the clock signal terminal within the certain time period is reduced, thereby reducing parasitic capacitance to be charged and discharged, reducing power consumed by the parasitic capacitance, and reducing power consumption of the display device. Meanwhile, since the noise may be introduced by charge and discharge of the parasitic capacitance, the GOA unit driving circuit of the embodiment of the present disclosure reduces parasitic capacitance to be charged and discharged, thereby reducing the noise introduced to the display device and improving display effect of the display device.

Second Embodiment

Figure 5:
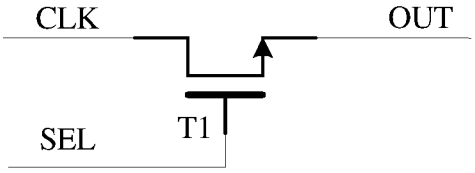
FIG. 5 is a schematic view of arrangement of a clock selecting unit according to a second embodiment of the present disclosure.

Referring to FIG. 5, a particular structure of a clock selecting unit in the GOA unit driving circuit will be illustrated, in which the clock selecting unit is only connected to one clock selection signal terminal. The clock selecting unit includes a first switching triode T1. A first electrode of the first switching triode T1 is connected to a clock selection signal terminal SEL, a second electrode of the first switching triode T1 (i.e., output terminal OUT of the clock selecting unit) is connected to the set of GOA units, and a third electrode of the first switching triode T1 is connected to a clock signal terminal CLK. It should be noted that the first switching triode T1 may be switching elements such as a transistor. If the first switching triode T1 is a transistor, the first electrode is a gate, the second electrode is a source, and the third electrode is a drain, or the first electrode is the gate, the second electrode is the drain, and the third electrode is the source.

Figure 6:
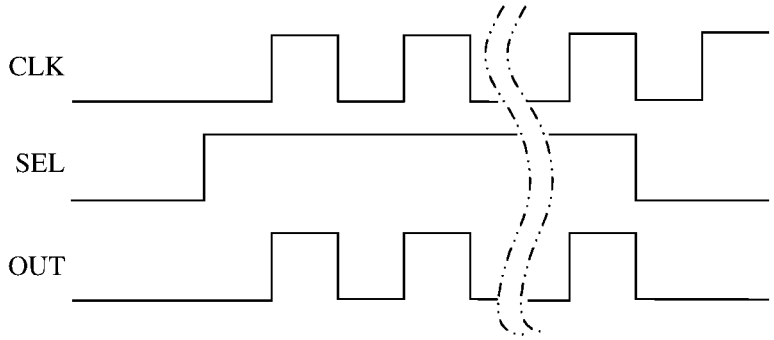
FIG. 6 is a signal timing chart corresponding to the clock selecting unit in FIG. 5.

Referring to FIG. 6, FIG. 6 is a signal timing chart corresponding to the clock selecting unit of FIG. 5. In the following, a method for driving the GOA unit circuit with the clock selecting unit of FIG. 5 will be described with reference to FIGS. 5 and 6. The first electrode of the first switching triode T1 receives the signal of the clock selection signal terminal SEL and the third terminal of the first switching triode T1 receives the signal of the clock signal terminal CLK. When the signal of the clock selection signal terminal SEL is a high-level signal, the first switching triode T1 is turned on so that the signal of the clock signal terminal CLK is transmitted to the set of GOA units connected to the first switching triode T1. That is, during the time period when the signal of the clock selection signal terminal SEL is a high level signal, the signal outputted from the second electrode of the first switching triode T1 (i.e., the output terminal OUT of the clock selecting unit) is the same as the signal of the clock signal terminal CLK. When the signal of the clock selection signal terminal SEL is a low level signal, the first switching triode T1 is turned off so as to stop transmitting the signal of the clock signal terminal CLK o the set of GOA units connected to the first switching triode T1. That is, during the time period when the signal of the clock selection signal terminal SEL is a low level signal, the signal outputted from the second electrode of the first switching triode T1 (i.e., the output terminal OUT of the clock selection unit) is a low level signal.

Third Embodiment

Figure 7:
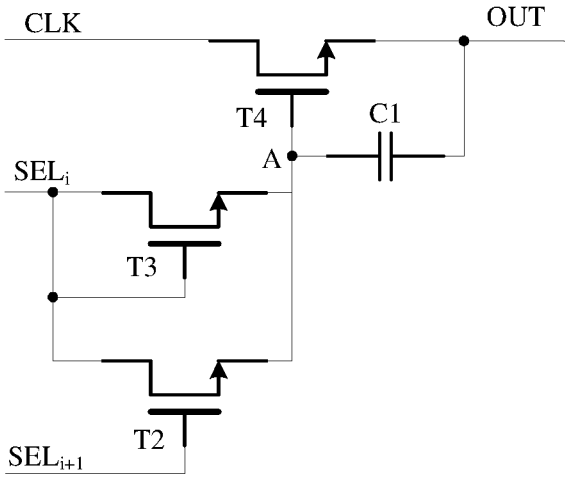
FIG. 7 is a schematic view of arrangement of a clock selecting unit according to a third embodiment of the present disclosure.

Referring to FIG. 7, another particular arrangement of the clock selecting unit in the GOA unit driving circuit will be described. The clock selecting unit is connected to two clock selection signal terminals which are the first clock selection signal terminal $SEL_{i+1}$ and the second clock selection signal terminal $SEL_i$. The clock selecting unit includes a second switching triode T2, a third switching triode T3, a fourth switching triode T4, and a first capacitor C1. A first electrode of the second switching triode T2 is connected to the first clock selection signal terminal $SEL_{i+1}$, a second electrode of the second switching triode T2 is connected to a first electrode of the fourth switching triode T4 and a first terminal of the first capacitor C1, and a third electrode of the second switching triode T2 is connected to the second clock selection signal terminal SELi. A first electrode of the third switching triode T3 is connected to the second clock selection signal terminal SELi, a second electrode of the third switching triode T3 is connected to the first electrode of the fourth switching triode T4 and the first terminal of the first capacitor C1, and a third electrode of the third switching triode T3 is connected to the second clock selection signal terminal $SEL_i$. The first electrode of the fourth switching triode T4 is connected to the second electrode of the second switching triode T2, the second electrode of the third switching triode T3 and the first terminal of the first capacitor C1, a second electrode of the fourth switching triode T4 is connected to the set of GOA units and a second terminal of the first capacitor C1, and a third electrode of the fourth switching triode T4 is connected to a clock signal terminal. It should be noted that the second switching triode T2, the third switching triode T3, and the fourth switching triode T4 may be switching elements such as transistors. If the second switching triode T2, the third switching triode T3, and the fourth switching triode T4 are transistors, the first electrodes are gates, the second electrodes are sources and the third electrodes are drains; or the first electrodes are the gates, the second electrodes are the drains and the third electrodes are the sources.

Figure 8:
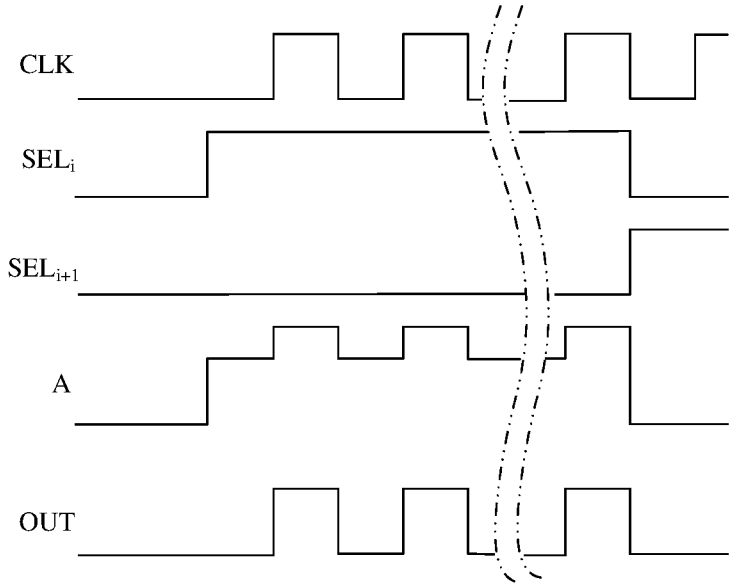
FIG. 8 is a signal timing chart corresponding to the clock selecting unit in FIG. 7.

Referring to FIG. 8, FIG. 8 is a signal timing chart corresponding to the clock selecting unit of FIG. 7. A method for driving the GOA unit circuit with the clock selecting unit of FIG. 7 will be described below in conjunction with FIGS. 7 and 8. The first electrode of the second switching triode receives the signal of the first clock selection signal terminal $SEL_{i+1}$. The third electrode of the second switching triode, the first and third electrodes of the third switching triode receive the signal of the second clock selection signal terminal $SEL_i$, and the third electrode of the fourth switching triode receives the signal of the clock signal terminal. When the signal of the first clock selection signal terminal $SEL_{i+1}$ is a low level signal and the signal of the second clock selection signal terminal $SEL_i$ is a high level signal, the second switching triode is turned off and the third switching triode is turned on, so that the third switching triode transmits the high level signal of the second clock selection signal terminal $SEL_i$ to the first electrode of the fourth switching triode and charges the first capacitor. In FIG. 7, point A is a connection point between the first terminal of the first capacitor and the first electrode of the fourth switch triode, so the signal at the point A is a high level signal. The first electrode of the fourth switch triode receives the high level signal so that the fourth switching triode is turned on to transmit the signal of the clock signal terminal to the set of GOA units connected to the second electrode of the fourth switching triode (i.e., the output terminal OUT of the clock selecting unit). Thus, the signal of the output terminal OUT of the clock selecting unit is the same as the signal of the clock signal terminal. When the signal of the clock signal terminal rises to a high level signal, the second electrode of the fourth switching triode (i.e. output terminal OUPUT of the clock selecting unit) charges the first capacitor. Due to a bootstrap effect of the first capacitor, the voltage of the first electrode of the first electrode of the fourth switching triode (i.e., the voltage at the point A) is further increased, and the fourth switching triode can be more completely turned on to more rapidly realize an object of driving the set of GOA units connected to the fourth switching triode. When the signal of the first clock selection signal terminal $SEL_{i+1}$ is a high level signal and the signal of the second clock selection signal terminal $SEL_i$ is a low level signal, the second switching triode is turned on and the third switching triode is turned off, the first electrode of the fourth switching triode is discharged through the second switching triode so that the signal of the first electrode of the fourth switching triode is decreased to a low level signal. The fourth switching triode is turned off to stop transmitting the signal of the clock signal terminal to the set of GOA units connected to the second electrode of the fourth switching triode.

Fourth Embodiment

The embodiment of the present disclosure provides a display panel including a GOA unit driving circuit in the above mentioned embodiments. The GOA unit driving circuit in the display panel has the same advantages as those of the GOA unit driving circuit in the above mentioned embodiments, so description thereof is omitted for brevity.

Fifth Embodiment

The embodiment of the present disclosure also provides a display device including a display panel in the above mentioned embodiments. The display panel in the display device has the same advantages as the display panel in the above-described embodiment, so description thereof is omitted for brevity. Specifically, the display device may be any products or components having a display function, such as liquid crystal display panel, an OLED (Organic Light Emitting Diode) panel, an electronic paper, a mobile phone, a tablet computer, a television set, a display, a notebook computer, a digital photo frame or the like.

In the GOA unit driving circuit and its driving method, the display panel and the display device provided by the present disclosure, the GOA unit driving circuit comprises a plurality of clock signal terminals, a plurality of clock selection signal terminals, a plurality of clock selecting units and a plurality of sets of GOA units. Each set of the GOA units comprises at least one GOA unit, and each of the clock selecting units is connected to a clock signal terminal, at least one clock selection signal terminal and a set of GOA units. As compared with the GOA unit driving circuit of the priory art in which each of the GOA units is directly connected to all of the clock signal terminals, the present disclosure divides all of the GOA units in the GOA unit driving circuit into a plurality of sets of GOA units, and the clock selecting unit in the GOA unit driving circuit is able to transmit signals at the clock signal terminal to the set of GOA units in a time division manner under control of the signal at the clock selection signal terminal, so that during a certain time period, only a part of the GOA units among all GOA units receive signals at the clock signal terminals, that is, the number of the GOA unit that receives the signal at the clock signal terminal within the certain time period is reduced, thereby reducing parasitic capacitance to be charged and discharged, reducing power consumed by the parasitic capacitance, and reducing power consumption of the display device.

In the description of the above-described embodiments, particular features, structures, materials, or characteristics may be combined in any one or more embodiments or examples in a suitable manner.

While the disclosure has been described in detail, it should be understood that the disclosure is not limited to the disclosed embodiments, but may be readily understood by those skilled in the art to which the present disclosure pertains, without departing from the scope of the disclosure and is intended to be within the scope of the present disclosure. Accordingly, the scope of protection of the present disclosure should be determined by the scope of the claims.

What is claimed is:

1. A gate driver on array (GOA) unit driving circuit comprising:

a plurality of sets of GOA units, each of which includes at least one GOA unit;

a plurality of clock selecting units, which are in one-to-one correspondence with the plurality of sets of GOA units, and each clock selecting unit is connected to a respective set of GOA units and a respective clock signal terminal, and each clock selecting unit is connected to at least one respective clock selection signal terminal of a plurality of clock selection signal terminals, respectively, wherein non-adjacent clock selecting units are connected to different clock selection signal terminals, wherein an intersection of any two sets of GOA units in the plurality of sets of GOA units is an empty set, and each clock selecting unit transmits a signal of the respective clock signal terminal to the respective set of GOA units, under control of a signal of the at least one respective clock selection signal terminal.

2. The GOA unit driving circuit according to claim 1, wherein one clock selecting unit is connected to one clock selection signal terminal, and the clock selecting unit comprises:

a first switch triode having a first electrode connected to the clock selection signal terminal, a second electrode connected to the set of GOA units corresponding to the clock selecting unit, and a third electrode connected to a clock signal terminal to which the clock selecting unit is connected.

3. The GOA unit driving circuit according to claim 1, wherein one clock selecting unit is connected to a first clock selection signal terminal and a second clock selection signal terminal, and the clock selecting unit comprises: a second switching triode, a third switching triode, a fourth switching triode and a first capacitor, wherein:

the second switching triode has a first electrode connected to the first clock selection signal terminal, a second electrode connected to a first electrode of the fourth switching triode and a first terminal of the first capacitor, and a third electrode connected to the second clock selection signal terminal;

the third switching triode has a first electrode connected to the second clock selection signal terminal, a second electrode connected to the first electrode of the fourth switching triode and the first terminal of the first capacitor, and a third electrode connected to the second clock selection signal terminal; and the fourth switching triode has a first electrode connected to the second electrode of the second switching triode, the second electrode of the third switching triode and the first terminal of the first capacitor, a second electrode connected to the set of GOA units corresponding to the clock selecting unit and a second terminal of the first capacitor, and a third electrode connected to one of the clock signal terminals.

4. The GOA unit driving circuit according to claim 3, wherein when a signal of the first clock selection signal terminal is a high level signal, a signal of the second clock selection signal terminal is a low level signal.

5. A method for driving a gate driver on array (GOA) unit driving circuit according to claim 1, comprising steps of, in each clock selecting unit:

receiving a clock selection signal from the at least one clock selection signal terminal and a clock signal from a clock signal terminal; and transmitting the clock signal to the set of GOA units corresponding to the clock selecting unit according to the clock selection signal.

6. The method according to claim 5, wherein:

the at least one clock selection signal terminal comprises one clock selection signal terminal;

the clock selecting unit comprises a first switch triode having a first electrode connected to the clock selection signal terminal, a second electrode connected to the set of GOA units corresponding to the clock selecting unit and a third electrode connected to a clock signal terminal to which the clock selecting unit is connected; and the step of receiving a clock selection signal from at least one clock selection signal terminal and a clock signal from a clock signal terminal comprises:

receiving the clock selection signal by the first electrode of the first switching triode; and receiving the clock signal by the third electrode of the first switching triode.

7. The method according to claim 6, wherein the step of transmitting the clock signal to the set of GOA units corresponding to the clock selecting unit according to the clock selection signal comprises:

when the clock selection signal is a high level signal, the first switching triode is turned on so that the clock signal is transmitted to the set of GOA units; and when the clock selection signal is a low level signal, the first switching triode is turned off so as to stop transmitting the clock signal to the set of GOA units connected.

8. The method according to claim 5, wherein:

the clock selection signal terminal comprises a first clock selection signal terminal and a second clock selection signal terminal, and the clock selecting unit comprises a second switch triode, a third switching triode, a fourth switching triode and a first capacitor, wherein:

the second switching triode has a first electrode connected to the first clock selection signal terminal, a second electrode connected to a first electrode of the fourth switching triode and a first terminal of the first capacitor, and a third electrode connected to the second clock selection signal terminal;

the third switching triode has a first electrode connected to the second clock selection signal terminal, a second electrode connected to the first electrode of the fourth switching triode and the first terminal of the first capacitor, and a third electrode connected to the second clock selection signal terminal;

the fourth switching triode has a first electrode connected to the second electrode of the second switching triode, the second electrode of the third switching triode and the first terminal of the first capacitor, a second electrode connected to the set of GOA units corresponding to the clock selecting unit and a second terminal of the first capacitor, and a third electrode connected to one of the clock signal terminals, and the step of receiving a clock selection signal from at least one clock selection signal terminal and a clock selection signal from a clock signal terminal comprises:

the first electrode of the second switching triode receiving a first clock selection signal from the first clock selection signal terminal;

the third electrode of the second switching triode, the first and third electrodes of the third switching triode receiving a second clock selection signal from the second clock selection signal terminal, and the third electrode of the fourth switching triode receiving the clock signal.

9. The method according to claim 8, wherein the step of transmitting the clock signal to the set of GOA units corresponding to the clock selecting unit according to the clock selection signal comprises:

when the first clock selection signal is a low level signal and the second clock selection signal is a high level signal, the second switching triode is turned off and the third switching triode is turned on so that the second clock select signal is transmitted to a first electrode of the fourth switching triode and the first capacitor is charged; the fourth switching triode is turned on so that the clock signal is transmitted to the set of GOA units; and when the first clock selection signal is a high level signal and the second clock selection signal is a low level signal, the second switching triode is turned on and the third switching triode is turned off so as to discharge the first electrode of the fourth switching triode through the second switching triode and the fourth switching triode is turned off so as to stop transmitting the clock signal to the set of GOA units.

10. A display panel comprising the gate driver on array (GOA) unit driving circuit according to claim 1.

11. A display device comprising the display panel according to claim 10.

* * * * *